US005202658A

United States Patent [19]

Everett et al.

[11] Patent Number: 5,202,658

[45] Date of Patent: Apr. 13, 1993

[54] LINEAR PROPORTIONAL SOLENOID

[75] Inventors: William F. Everett, Goshen; Kevin C. Heick, South Bend, both of Ind.; Peter G. Hutchings, Rockaway, N.J.; Matthew E. Leinheiser, South Bend, Ind.

[73] Assignee: South Bend Controls, Inc., South Bend, Ind.

[21] Appl. No.: 662,911

[22] Filed: Mar. 1, 1991

[51] Int. Cl.[5] ..... H01F 7/08

[52] U.S. Cl. ..... 335/230; 335/258

[58] Field of Search ..... 335/229, 230, 234, 236, 335/299, 300, 258, 78, 79, 170, 253; 251/65

[56] References Cited

U.S. PATENT DOCUMENTS 4,403,765 9/1983 Fisher ..... 335/236 X 4,463,332 7/1984 Everett ..... 335/258

4,774,485 9/1988 Dietrich ..... 335/230

4,835,503 5/1989 Everett ..... 335/229

4,988,074 1/1991 Najmolnoda ..... 335/230 X

FOREIGN PATENT DOCUMENTS 1414815 10/1960 Fed. Rep. of Germany ..... 335/230

*Primary Examiner*—Leo P. Picard

*Assistant Examiner*—Trinidad Korka

*Attorney, Agent, or Firm*—James D. Hall

[57] ABSTRACT

A solenoid device having an output which is substantially linearly proportional to its electrical input and which includes an axially adjustable polepiece. The polepiece carries a permanent magnet which is annularly disposed about the polepiece and which provides an efficient magnetic circuit in conjunction with the electromagnetic coil of the solenoid.

9 Claims, 2 Drawing Sheets

LINEAR PROPORTIONAL SOLENOID

BACKGROUND OF THE INVENTION

This invention relates generally to rectilinear motion proportional solenoids and has application to solenoids which produce a motion-directed output which is linearly proportional to the electrical input current applied to the coil of the solenoid.

Linear proportional solenoids are shown and described in U.S. Pat. Nos. 4,463,332; 4,767,097; and 4,835,503. In each of these patents, the permanent magnet whose magnetic field aids the magnetic field created by the electrical current-induced coil has various operative locations. In U.S. Pat. Nos. 4,463,332 and 4,767,097 the permanent magnet surrounds the coil. In U.S. Pat. No. 4,835,503 the permanent magnet is placed interiorly of the coil and located in the end face of the polepiece. In each of the aforementioned patents, there are two linear springs which are positioned within the flux path of the solenoid and which carry the moveable armature of the solenoid.

It will be observed that in each of the aforementioned solenoid designs, there are a multiplicity of parts which adds to the overall production costs and general size of the solenoid.

SUMMARY OF THE INVENTION

In the following described invention, the solenoid includes a housing in which there is mounted a moveable armature assembly and a polepiece spaced from the armature assembly. A coil is also carried within the housing for inducing magnetic flux through the polepiece and armature assembly. A permanent magnet is carried by the polepiece. The permanent magnet extends annularly about the polepiece so as to increase the permanence of the magnetic circuit created by the coil through the armature assembly and polepiece. The armature assembly may utilize a single linear spring which provides a more efficient flux path within the solenoid.

The magnetic circuit design of the solenoid of this invention is highly efficient and allows for a significant reduction in the number of components or parts of the solenoid. By reducing the number of parts of the solenoid, a linear proportional solenoid can be produced of economic construction and of smaller size than those solenoids previously discussed in the above paragraphs.

Therefore, it is an object of this invention to provide a linear proportional solenoid having an efficient magnetic circuit design.

Another object of this invention is to provide a linear proportional solenoid having a minimal number of parts but which includes an adjustable polepiece for varying the gain or rate of displacement of the solenoid after its assembly.

Still another object of this invention is to provide a linear proportional solenoid which is of compact design and of economic construction.

And still another object of this invention is to provide a linear proportional solenoid which is of rigid assembly so as to resist thermal and mechanical shock during its intended use.

Other objects of this invention will become apparent upon a reading of the following description.

DESCRIPTION OF THE PREFERRED EMBODIMENTS

Figure 1:
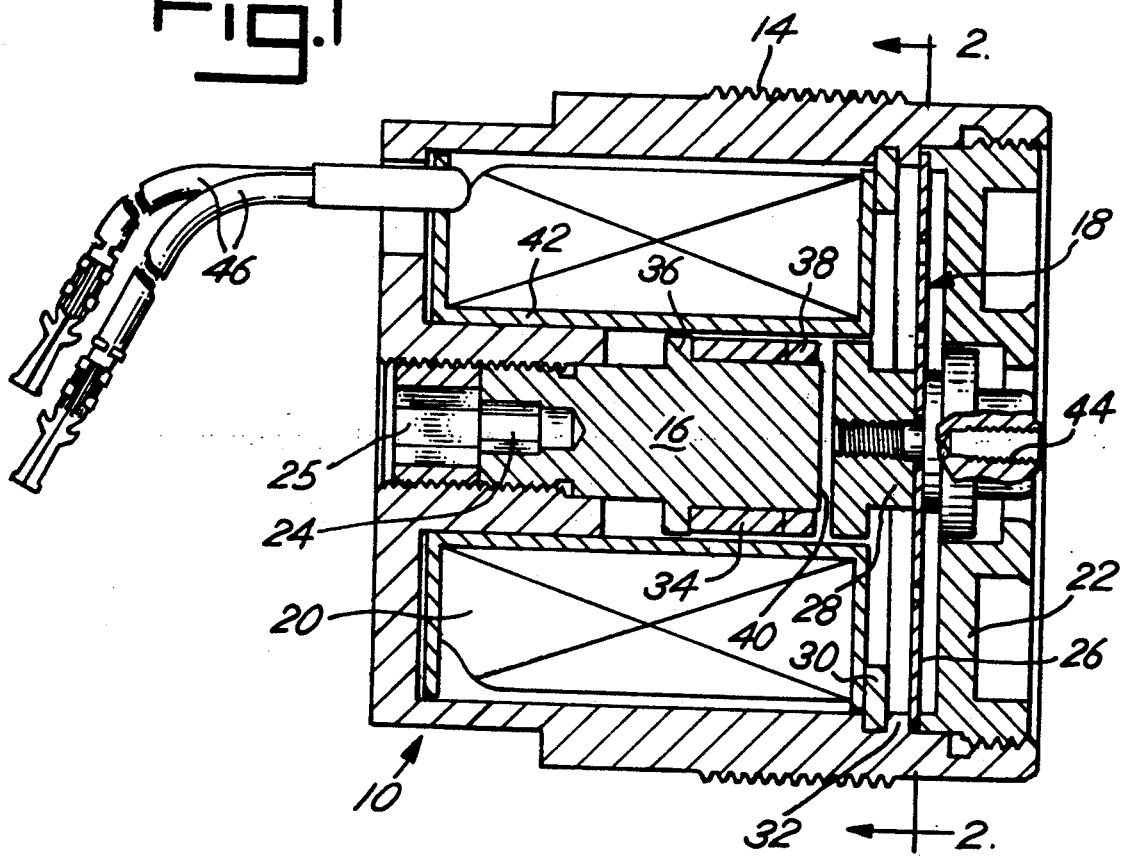
FIG. 1 is a longitudinal sectional view of one embodiment of the solenoid of this invention.
Figure 2:
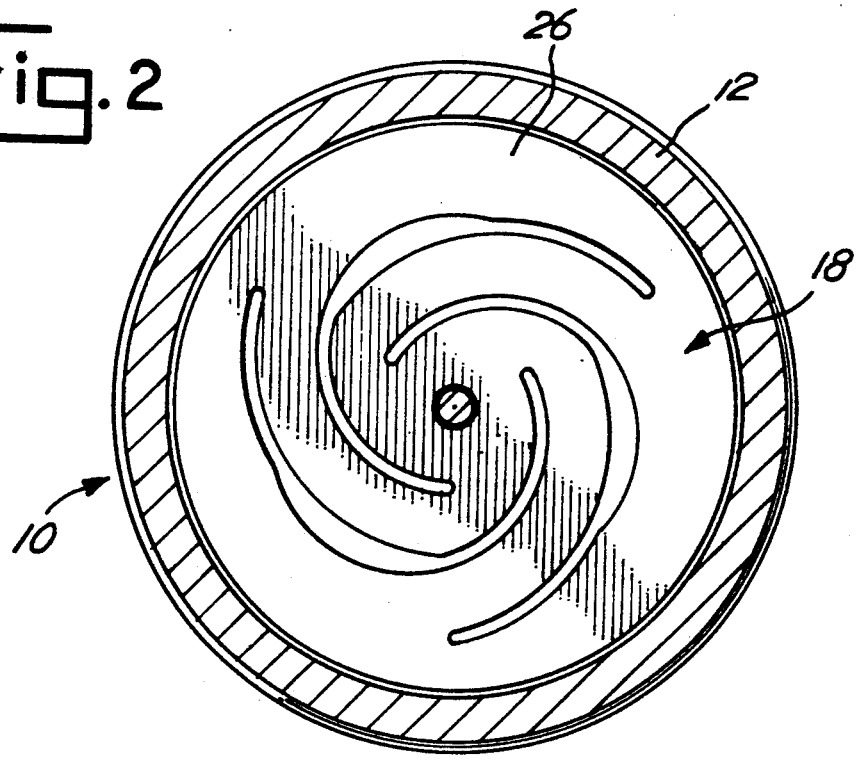
FIG. 2 is a cross sectional view taken along line 2—2 of FIG. 1.

Solenoid 10 shown in FIGS. 1 and 2 includes a housing 12 which is adapted by exterior threads 14 to be connected to a valve assembly (not shown). Illustrations of such valve assemblies are found in U.S. Pat. Nos. 4,767,097 and 4,835,503, both incorporated herein by reference. Solenoid 10 further includes a polepiece 16, an armature assembly 18, an electromagnetic coil 20, and a front ring 22.

Polepiece 16 is threadably connected to housing 12 and is adjustable axially with respect to the housing by insertion of a keyed tool (not shown) into bore 24 of the polepiece and locked in position with lock-nut 25. Such movement of the polepiece serves to vary the spacing between the polepiece and armature assembly which allows adjustment in gain or calibration of the solenoid. Armature assembly 18 is of a three-component construction which includes a single component linear spring part 26 and a two-component armature part 28. The components of armature part 28 are connected together by threaded attachment on opposite sides of spring part 26 so as to clamp the spring part between the armature part components. Coil 20 is retained within housing 12 by a retainer ring 30 fitted into a receiving groove within the housing.

Armature assembly 18 is secured within housing 12 by front ring 22 which is threaded into the housing and which serves to clamp the outer circumferential periphery of spring part 26 against annular shoulder 32 of the housing. A permanent magnet 34 which is of cylindrical form extends in an annular orientation about the polepiece abutted against an annular inset flange 36 of the polepiece. An annular ring 38 is fitted about polepiece 16 in abutment with the opposite end of magnet 34 at the end face 40 of the polepiece. Magnet 34 is preferably formed from rare earth materials, such as samarium cobalt. Housing 12, polepiece 16, ring 38, spring part 26, armature part 28, and front ring 22 are all formed from ferrous materials. As illustrated in FIG. 1, there is a space, commonly known as a core gap, between end face 40 of polepiece 16 and armature part 28. There are also spaces, commonly known as side gaps, between armature part 28 and front ring 22. The bobbin 42 which carries the windings for coil 20 is of a nonmetallic construction, such as plastic. The threaded bore 44 to the front of armature part 28 is used to secure the valve assembly to the armature for actuation upon axial movement of the armature part relative to housing 12.

The manner of operation of a linear proportional solenoid of the general form of above described is explained in detail in U.S. Pat. No. 4,463,332, incorporated herein by reference, as well as the aforementioned U.S. Pat. Nos. 4,767,097 and 4,835,503. As such, a detailed explanation of the operation of solenoid 10 will not be repeated since any one of ordinary skill in the art will have more than adequate understanding of the technical manner of operation of the solenoid. What will be described is the manner in which permanent magnet 34 and single spring part 26 contribute to a more efficient magnetic circuit design.

To actuate solenoid 10, a current is applied through leads 46 to coil 20 which induces a flux path through polepiece 16, armature part 28, front ring 22 and housing 12. Variations in current through coil 20 produces a variation in the flux density between the polepiece and the armature part resulting in a corresponding variation in movement of the armature part. This flux density is reinforced by the constant flux density produced by permanent magnet 34 with only minimal interruptions in the flux path about the housing and through the polepiece, armature and front ring. Collar 36 of polepiece 16 and ring 38 serve to turn the flux produced by permanent magnet 34 as its flux passes into and around armature part 28. As explained in U.S. Pat. No. 4,463,332, use of the permanent magnet serves to provide an initial magnetic flux level which assists to produce the substantially linear operating relationship between the axial movement of the armature part 28 relative to housing 12 and the input current to coil 20.

Only a single spring part 26 is utilized in the armature assembly 18, unlike the dual springs utilized in the aforementioned U.S. Patents. The use of a single spring part permits the spring part to be secured within housing 12 by direct mechanical application without the spring having to be brazed or otherwise secured within a retainer, thus allowing the spring to be manufactured from materials chosen for stability. Further, the use of the single spring part provides for a more efficient flux path through the solenoid.

Figure 3:
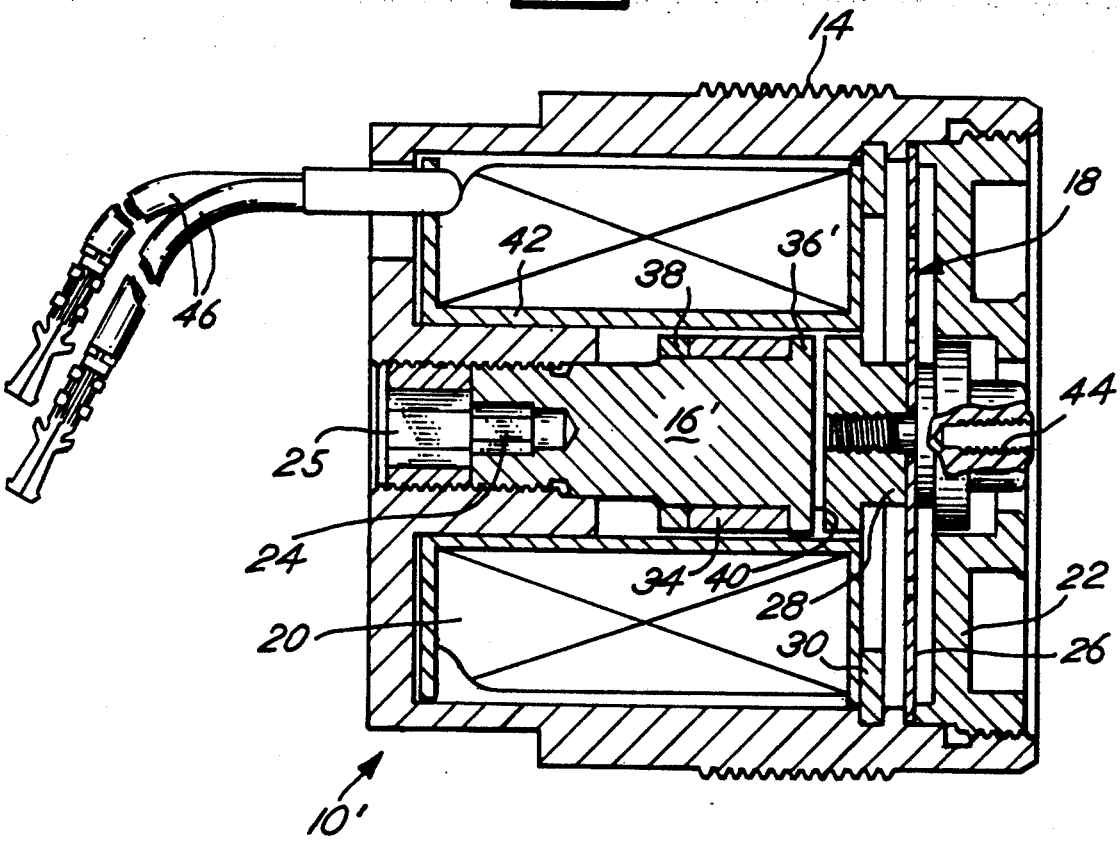
FIG. 3 is a longitudinal sectional view of a second embodiment of the solenoid of this invention.

The embodiment of the solenoid of this invention illustrated in FIG. 3 and identified as solenoid 10' is of the same construction and mode of operation as that described for solenoid 10 of FIGS. 1 and 2 with the exception of the construction of the polepiece. As such, corresponding parts of solenoid 10' shown in FIG. 3 are identified by the same reference numerals as shown in FIGS. 1 and 2 with respect to solenoid 10. The modified polepiece of solenoid 10', hereinafter referred to by the reference numeral 16', is provided with an annular flange 36' at its end, located adjacent armature part 28. Permanent magnet 34 extends annularly about polepiece 16' in abutment at one end with flange 36'. Ring 38 extends about the polepiece and abuts the opposite end of magnet 34. Magnet 34 serves the same purpose in the embodiment of FIG. 3 as described for the embodiment of the solenoid of FIGS. 1 and 2 with flange 36' and ring 38 serving to turn the flux path of the permanent magnet as it flows into armature part 28. As stated previously, the method of operation and the functional purposes of the component parts of solenoid 10' is the same as described for solenoid 10 of FIGS. 1 and 2.

In solenoids 10 and 10' there is a more efficient magnetic circuit which minimizes flux linkage. The component parts of the solenoids are reduced in number, creating a more rigid assembly which resists thermal and mechanical shock.

This invention is not to be limited to the details above given, but may be modified within the scope of the appended claims.

What we claim is:

1. A linear proportional solenoid comprising a housing, a moveable armature assembly within said housing, a polepiece carried within said housing and spaced from and in axial alignment with said armature assembly, an electromagnetic coil means within said housing for inducing magnetic flux through said polepiece and said armature assembly in response to an electrical input into said coil means, a permanent magnet carried by said polepiece and located adjacent said armature assembly, said magnet extending annularly about said polepiece.

2. The solenoid of claim 1 wherein said magnet is of cylindrical configuration and fitted upon said polepiece, said polepiece having an end face spaced from said armature assembly, said magnet being axially displaced from said pole end face in a direction away from said armature assembly.

3. The solenoid of claim 2 and annular abutment means carried by said polepiece at opposite ends of said magnet for directing the flux of said magnet.

4. The solenoid of claim 3 wherein said abutment means is a flange forming an integral part of said polepiece and a ring carried about the polepiece.

5. The solenoid of claim 4 wherein said ring is substantially flush with said polepiece end face.

6. The solenoid of claim 4 wherein said flange is substantially flush with said polepiece end face.

7. The solenoid of claim 1 wherein said armature assembly includes a flattened spring and an armature part carried at the center of said spring, said armature part in axial alignment with and spaced from said polepiece end face, said spring having a peripheral edge and secured to said housing at its said peripheral edge.

8. The solenoid of claim 7 wherein said housing includes an internal annular shoulder, said spring at one side abutting said annular shoulder at the peripheral edge of said spring, retainer means engaging said housing and located at the opposite side of said spring at its said peripheral edge for clamping the spring against said annular shoulder.

9. The solenoid of claim 2 and means movably securing said polepiece with said housing for shifting the polepiece relative to said armature assembly to vary the spacing between the polepiece and armature assembly.

* * * * *